United States Patent [19]

Omori

[11] Patent Number: 4,524,690

[45] Date of Patent: Jun. 25, 1985

[54] WATER SUPPLY APPARATUS FOR PRINTING PRESS

[75] Inventor: Tamotsu Omori, Toride City, Japan

[73] Assignee: Komori Printing Machinery Co., Ltd., Tokyo, Japan

[21] Appl. No.: 529,924

[22] Filed: Sep. 7, 1983

Related U.S. Application Data

[63] Continuation of Ser. No. 292,388, Aug. 13, 1981, abandoned.

[30] Foreign Application Priority Data

Aug. 14, 1980 [JP] Japan ..... 55-110992
Jan. 22, 1981 [JP] Japan ..... 56-8404
Jan. 22, 1981 [JP] Japan ..... 56-8407

[51] Int. Cl.[3] ..... B41F 7/40; B41L 25/16
[52] U.S. Cl. ..... 101/148; 101/352
[58] Field of Search ..... 101/148, 350, 351, 352, 101/349, 206–209, 247

[56] References Cited

U.S. PATENT DOCUMENTS 2,653,539 9/1953 Halley ..... 101/352
3,411,442 11/1968 Muhlich ..... 101/148
3,673,959 7/1972 Jezuit ..... 101/148
3,688,694 9/1972 Preuss et al. ..... 101/148
3,749,011 7/1973 Abendroth et al. ..... 101/148
3,842,735 10/1974 Southam et al. ..... 101/148
3,911,815 10/1975 Banfer ..... 101/148
3,986,452 10/1976 Dahlgren ..... 101/148
4,127,067 11/1978 Dahlgren ..... 101/148
4,130,057 12/1978 List ..... 101/148
4,351,236 9/1982 Beisel et al. ..... 101/148

FOREIGN PATENT DOCUMENTS 2035903 6/1980 United Kingdom ..... 101/148

*Primary Examiner*—J. Reed Fisher
*Attorney, Agent, or Firm*—Remy J. VanOphem

[57] ABSTRACT

In a printing press wherein wetting water is supplied to a platen roller thereof through a group of rollers including a water feed roller immersed in a body of water, an adjusting roller, a transfer roller and a water supply roller in contact with the platen roller, the water supply roller is positioned remote from an inking roller. The transfer roller is rotated at a peripheral speed of 1.5 times to twice of that of the water feed roller.

20 Claims, 13 Drawing Figures

FIG.11
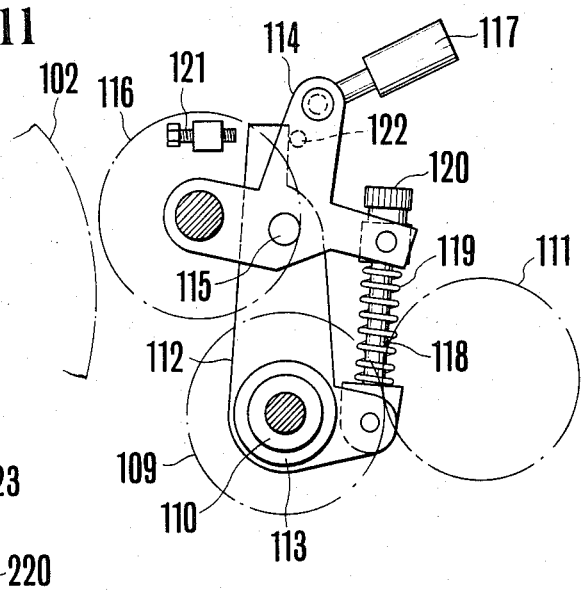
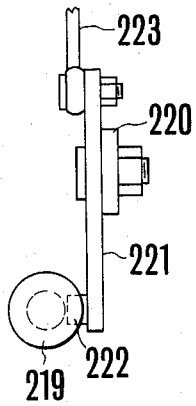
FIG.13
FIG.12
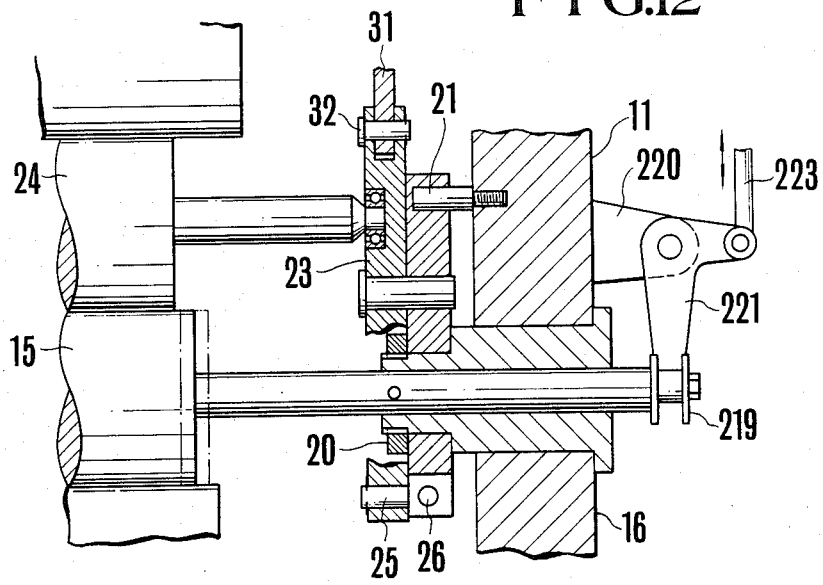

WATER SUPPLY APPARATUS FOR PRINTING PRESS

This is a continuation of application Ser. No. 292,388, filed Aug. 13, 1981, now abandoned.

BACKGROUND OF THE INVENTION

This invention relates to a water supply apparatus for continuously supplying wetting water to the plate on a plate cylinder of a printing press.

In lithographic printing an original (or a mother) printing pattern is formed on the surface of a plate which has been pretreated to be hydrophilic with a transfer or photo plate manufacturing technique, and then the plate is chemically treated to provide a final product, that is, a lithographic printing plate. The plate is mounted on a plate cylinder, and printing ink and wetting water are supplied to the plate at the time of printing. Water is repelled at those portions of the pattern which are oilphilic, whereas water is absorbed by hydrophilic portions so that when oily ink is supplied to the plate, the ink adheres to the oilphilic portions whereas the ink is repelled at other portions, thus forming an ink picture pattern which is transfer printed onto a sheet of printing paper.

The water supply apparatus utilized for this purpose includes a water feed roller rotating in a water container, a swinging roller and a transfer roller supported by a swinging lever to reciprocate between the water feed roller and the swinging roller to intermittently transfer the water on the water feed roller to the swinging roller. The water transferred to the transfer roller is supplied to the plate cylinder.

With this water supply apparatus, since water is supplied intermittently by the reciprocating motion of the transfer roller, water feed becomes nonuniform which results in variations in the quantity of the deposited ink, thus impairing the quality of the printed matter. To obviate this difficulty, various forms of improved water supply apparatus have been proposed which can continuously supply wetting water without using the transfer roller.

FIG. 1 of the accompanying drawings illustrates one known example of such continuous water supply apparatus disclosed in U.S. Pat. No. 3,411,442, in which a plurality of inking rollers 2 are removably mounted on a plate cylinder 1 for continuously and uniformly supplying wetting water to a plate mounted on the plate roller from an ink pot, not shown. The water supply apparatus 3 includes a water feed roller 5 rotating in a water container 4, a transfer roller 6 rotating in the opposite direction with respect to the water feed roller 5, a water quantity adjusting roller 7 in contact with both rollers 5 and 6 and rotating in the same direction as the water feed roller 5, and a water applying or water supply roller 8 removably mounted on the plate cylinder 1. Between one of the inking rollers 2 and the water supply roller 8 is disposed an intermediate roller 9 in contact with the two rollers 2 and 8. At the commencement of the printing operation, the water supply roller 8 is separated away from the plate cylinder 1; the water in the container 4 is admixed with ink on the inking rollers 2 through the water feed roller 5, the adjusting roller 7, the transfer roller 6, water supply roller 8 and the intermediate roller 9; and the mixture of water and ink is then supplied to the plate cylinder 1. After starting the printing operation the water supply roller 8 is brought into contact with the plate cylinder 1 to directly supply water.

With the water supply apparatus 3 thus far described, the ink films on the inking rollers 2 are thick and the water tends to be admixed with ink. Most of the water remains on the inking rollers 2 without being transferred to the plate cylinder 1 so that the quantity of water returned to the water supply roller 8 is extremely small. Further, the water not absorbed by paper after being supplied to the plate cylinder can not return to the water supply roller. Accordingly, the quantity of water supplied by the water supply apparatus must be accurately adjusted which requires a high degree of skill. When the adjusting operation requires a long time, a large quantity of unsatisfactory printed matter is produced meaning a loss of paper. Where a large quantity of water is admixed with ink, the ink is excessively emulsified which greatly impairs the quality of the printed matter. In an extreme case this makes it impossible to print.

SUMMARY OF THE INVENTION

Accordngly, it is an object of this invention to provide an improved water supply apparatus for a printing press which can uniformly supply wetting water to the plate cylinder of the printing press without causing emulsification of the printing ink.

Another object of the invention is to provide a water supply apparatus for a printing press which supplies the minimum required wetting water to the plate cylinder.

Still another object of the invention is to provide a water supply apparatus for a printing press wherein the physical thickness and speed of the wetting water supplied to the plate cylinder can be adjusted readily and accurately.

Another object of the invention is to provide a water supply apparatus for a printing press which make it unnecessary to incorporate alcohol into the wetting water.

Still another object of this invention is to provide an improved water supply apparatus for a printing press capable of preventing printing ink from being transferred to a water transfer roller thereby improving the quality of the printed matter.

A further object of this invention is to provide a water supply apparatus for a printing press capable of eliminating stripes on the printed matter printed with a printing press of the type wherein the plate cylinder is suppled with wetting water at the time of printing.

According to this invention there is provided a water supply apparatus for a printing press including a rotatable water supply roller in contact with a plate cylinder of the printing press and having a resilient surface; a transfer roller in contact with the water supply roller and rotated at the same peripheral speed as the plate cylinder, the transfer roller having a hydrophilic surface; an adjusting roller in contact with the transfer roller and rotated in a direction opposite at the contact to the direction of rotation of the transfer roller, the adjusting roller having a resilient surface; a water feed roller in contact with the adjusting roller and having a hydrophilic surface, the water feed roller being immersed in a body of water in a water container; and apparatus for adjusting the contact pressure between the adjusting roller and the water supply roller, the water supply roller being positioned remote from an inking roller for the plate cylinder. Alternatively, the water feed roller is omitted, in which case the adjusting roller is immersed in the body of water to act as the water feed roller.

It is advantageous to rotate the adjusting roller at a peripheral speed of 1.5 times to twice of that of the water feed roller, and to reciprocate the transfer roller in the axial direction for eliminating strips tending to be formed on the printed matter.

BRIEF DESCRIPTION OF THE DRAWINGS

Further objects and advantages of this invention can be more fully understood from the following detailed description taken in conjunction with the accompanying drawings in which:

FIGS. 10 and 11 are side views similar to FIG. 8 utilized to explain the operation of the modification shown in FIGS. 8 and 9;

FIG. 12 is a vertical sectional view of the mechanism for axially swinging the transfer roller; and FIG. 13 is a side view showing the swinging mechanism shown in FIG. 12.

DESCRIPTION OF THE PREFERRED EMBODIMENT

Figure 1:
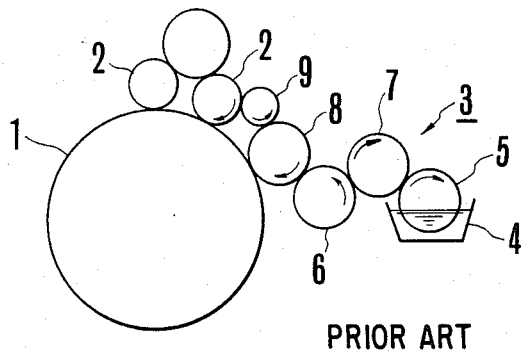
FIG. 1 is a diagrammatic side view showing a prior art water supply apparatus and inking rollers of a rotary printing press.

Referring now to FIGS. 2 through 5 of the accompanying drawings, a plate cylinder 12 rotating in the counterclockwise direction A is journalled by a machine frame 11, and a pair of swinging rollers 13 are journalled above the plate cylinder 12.

A pair of inking rollers 14 are arranged between each swinging roller 13 and the plate cylinder 12, the inking rollers 14 being supported by roller supporting arms to be swingable about the swinging rollers 13. The inking rollers 14 are constructed to be removably mounted on the plate cylinder 12 while being engaged with the swinging rollers 13. Ink transferred to the swinging rollers 13 from an ink pot, not shown, through a plurality of roller groups is supplied to the plate cylinder 12 by the inking rollers 14.

On the right hand side of the plate cylinder 12 supplied with ink in this manner is provided a transfer roller 15 having a hydrophilic surface and journalled by the frame 11 through a bearing 16. The transfer roller 15 is driven by a drive source through gears 17 and 18 at one end of the transfer roller 15 to rotate in the counterclockwise direction B (see FIG. 2) at the same peripheral speed as the plate cylinder 12. A shift lever 19 prevented from axial movement by a collar 20 is rotatably fitted on the bearing 16 that supports the transfer roller 15, the range of swinging of the lever 19 being limited by a stop member 21 threaded into the frame 11 and an adjusting screw 22 mounted on the frame 11. An inverted T-shaped roller supporting lever 23 is pivotally connected to an intermediate point of the lever 19, and a water supply roller 24 having a resilient surface is supported on one end of the horizontal leg of the lever 23, the water supply roller 24 rotating in a direction C opposite to the direction of rotation B of the transfer roller 15 in contact therewith. A rod receiver 25 is provided for the other end of the horizontal leg of the lever 23, and one end of an adjusting rod 28 is inserted through an opening 26 of the projection of the rod receiver 25, the other end of the adjusting rod 28 being connected to an arm of the lever 19 through a pin 27. The upper end of the adjusting rod 28 is formed with screw threads for receiving an adjusting nut 29. A compression spring 30 is interposed between the rod rod receiver 25 and the lower shoulder of the adjusting rod 28 for rotating the lever 23 in the counterclockwise direction as viewed in FIG. 3 to urge the water supply roller 24 against the roller 15. Accordingly, the contact pressure between the rollers 15 and 24 can be adjusted by rotating the adjusting nut 29. The piston rod of an air piston-cylinder assembly 31 is pivotally connected to the upper end of the vertical leg of the lever 23 by a pin 32 so that when the air piston-cylinder assembly 31 is operated the levers 23 and 19 are swung in unison so that the water supply roller 24 is caused to move into or out of contact with the plate cylinder 12 while the rollers 15 and 24 are maintained in contact.

A lever shaft 33 having an integral shaft supporting portion **33*a* which is eccentric by t (see FIG. 4), a lever supporting portion 33*b* and a flange 33*c* is rotatably journalled by the frame 11 on one side of the transfer roller 15. The axial movement of the shaft 33 is prevented by a nut 34 and a shoulder between the portions 33*a* and 33*b*. A disc shaped holder 35 is rotatably connected to the flange 33*c* of the lever shaft 33 through a pin 36. The holder 35 is constructed to be fixed to the flange 33*c* at two positions. More particularly, the flange 33*c* is provided with two pin openings 37 and 38 (see FIG. 3) along a circle having a center at pin 36. A pin 40 urged by a compression spring 39 toward pin openings 37 and 38 is mounted on the holder 35 so that, after withdrawing the pin 40 out of the pin openings 37 and 38, the holder 35 may be rotated, and when the pin 40 is inserted into either one of the openings 37 and 38, the holder 35 is fixed. A roller or roller supporting lever 41 is fitted concentrically on the lever supporting holder portion 33*b* with a spacer 42 interposed between the frame 11 and the roller supporting lever 41. A roller supporting shaft 43 including an integral shaft supporting portion 43*a* having an eccentricity of t, as shown in FIG. 4, and a bearing portion 43*b* is rotatably supported by the lower portion of the roller supporting lever 41 with its axial movement prevented by a nut 44 and a shoulder between the portions 43*a* and 43*b***.

Figure 3:
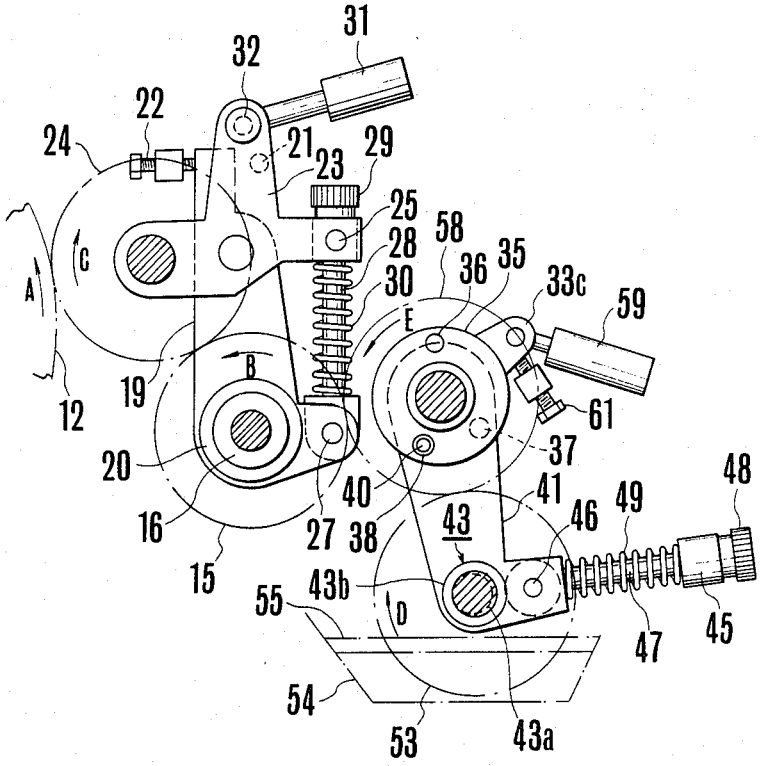
FIG. 3 is a side view showing the detail of the water supply apparatus.
Figure 4:
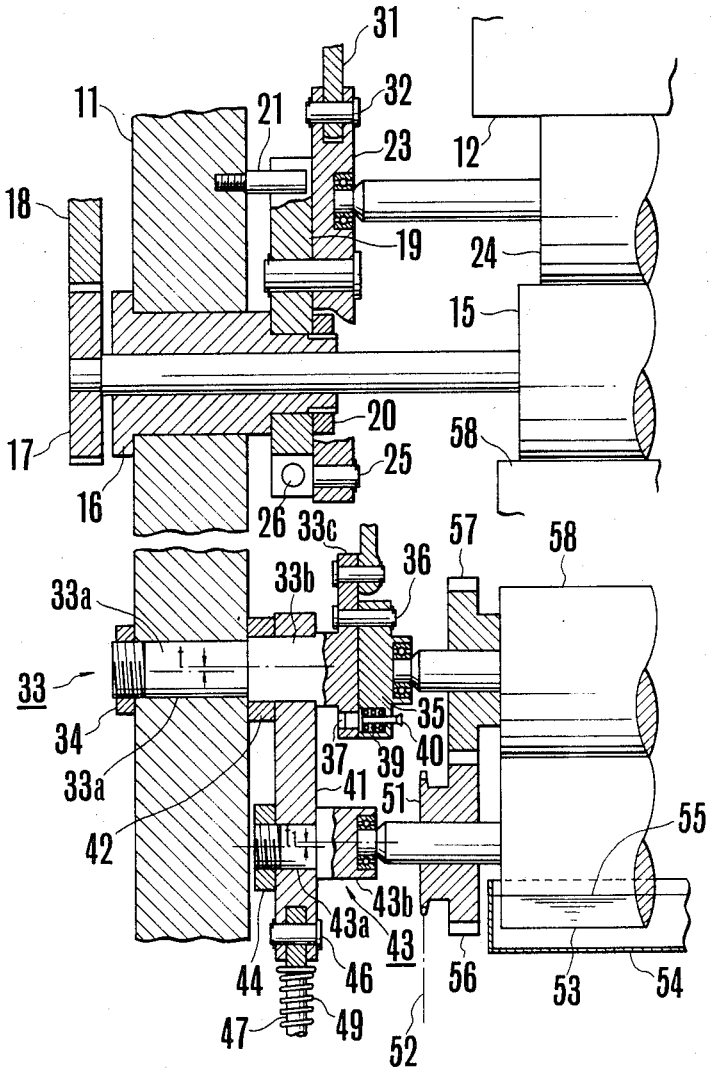
FIG. 4 is a longitudinal sectional view of the water supply apparatus shown in FIG. 3.

On the right hand side as viewed in FIG. 3 of the lower portion of the roller lever 41, a rod receiver 45 is secured to the frame 11, and one end of an adjusting rod 47 is pivotally connected to the horizontal arm of the roller lever 41 by a pin 46. The other end of the adjusting rod 47 extends through the rod receiver 45. The periphery of one end of the adjusting rod 47 is provided with screw threads for receiving an adjusting nut 48. A compression spring 49 is interposed between the rod receiver 45 and the horizontal arm of the roller lever 41 for urging the same in the clockwise direction as viewed in FIG. 3. A water feed roller 53 having a hydrophilic surface immersed in a body of water 55 in a container 54 is supported by the bearing portion 43*b* of the roller supporting shaft 43. The water feed roller 53 is rotated by an electric motor 50 through a chain 52 and a sprocket wheel in the counterclockwise direction D in the same direction and at the same speed as the water supply roller 24. The holder 35 also supports an adjusting roller 58 having a resilient surface and driven by the water feed roller 53 through gears 56 and 57 to rotate in the clockwise direction. The piston rod of an air piston cylinder assembly 59 is pivotally connected to the flange 33*c* of the lever supporting shaft 33 by a pin 60 so that, as the piston-cylinder assembly 59 is operated, the lever supporting shaft 33 is rotated so as to cause the adjusting roller 58 to move into or out of contact with the transfer roller 15 by the eccentricity of the shaft 33. An adjusting screw 61 is threaded into the frame 11 for controlling the contact pressure between the rollers 58 and 15 by engaging the flange 33*c*. A rotary lever, not shown, is provided for the bearing portion 43*b* of the roller supporting shaft 43 for rotating the bearing portion 43*b* so as to adjust the contact pressure between the adjusting roller 58 and the water feed roller 53. When the holder 35 is rotated so as to insert the pin 40 into the pin opening 37, the adjusting roller 58 is separated from the water feed roller 53.

The water supply apparatus described above operates as follows. Prior to the printing operation, the adjusting nut 29 is rotated for adjusting the contact pressure between the water supply roller 24 and the transfer roller 15. Further, the roller supporting shaft 43 is rotated to adjust the contact pressure between the water feed roller 53 and the adjusting roller 58. The left and right hand adjusting nuts 48 are rotated for independently rotating the left and right hand roller supporting levers 41 to twist the axis of the water feed roller 53 with respect to the axis of the adjusting roller 58, thus changing the contact pressure between these rollers along their axes.

In the not printing state after the adjustment described above, the piston rod of the air piston-cylinder assembly 31 is retracted to cause the lever 19 to engage the stop member 21 so that only the roller supporting lever 23 rotates in the clockwise direction to compress the compression spring 30. Under this state, the water supply roller 24 is separated from both of the plate cylinder 12 and the transfer roller 15. On the other hand, the piston rod of the piston cylinder assembly 59 is retracted so as to separate the adjusting roller 58 from the transfer roller 15 by the eccentricity of the lever supporting shaft 33 while maintaining the adjusting roller 58 in contact with the water feed roller 53. To start the printing operation, the piston cylinder assembly 31 is operated to cause the compression spring 30 to urge the water supply roller 24 against the transfer roller 15 and then to simultaneously rotate the roller supporting lever 23 and the lever 19 to urge the water supply roller 24 against the plate cylinder 12. The contact pressure between the water supply roller 24 and the plate cylinder 12 is controlled by the adjusting screw 22. Further, when the air piston cylinder assembly 59 is actuated, the adjusting roller 58 is brought into contact with the transfer cylinder 15 by the eccentricity of the lever supporting shaft 33 while the roller 58 is maintained in contact with the water feed roller 53. The contact pressure of the adjusting roller 58 is controlled by the adjusting screw 61. Concurrently with contacting of all water carrying rollers and inking roller 14, the supply of the printing ink onto the plate cylinder 12 is commenced.

Figure 5:
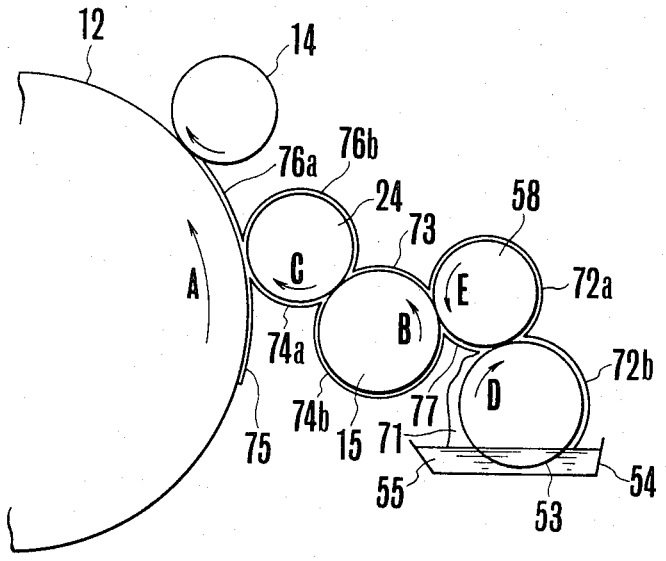
FIG. 5 is a side view of the water supply apparatus useful to explain the operation thereof.

The water feed operation after commencement of the printing operation will now be described with reference to FIG. 5. Thus, a portion of the water 55 in the container 54 is picked up as a water film 71 by the water feed roller 53 rotating in the clockwise direction D and is then applied to the nip between the adjusting roller 58 and the water feed roller 53. Since the contact pressure at this nip is adjusted by the roller supporting shaft 43 and the adjusting nut 48 as above described, only a portion of the water film 71 passes through the nip, and the remaining portion falls down back into the container 54. The water film 71 passed through the nip is divided into two portions, one portion 72*a* passing about the periphery of the adjusting roller 58 rotating in the counter clockwise direction E with the other portion 72*b* being returned to the container 54 by the water feed roller 53. When the water film 72*a* carried by the adjusting roller 58 reaches the nip between the adjusting roller 58 and the transfer roller 15, as these rollers are rotating in the opposite directions, at their contact point most of the water is transferred onto the transfer roller 15 as a water film 73 to be conveyed in the counterclockwise direction. In most cases as the peripheral speed of the transfer roller 15 is larger than that of the adjusting roller 58, the thickness of the water film 73 is determined by the peripheral speeds of the rollers 58 and 15 and the thickness of the water film 72*a* conveyed to the nip. When the water film 73 conveyed by the transfer roller 15 reaches the nip between it and the water supply roller 24, the water film 73 is divided into two portions because both rollers 15 and 24 are rotating in the same direction at their contact point and since the contact pressure is adjusted by the adjusting nut 29. One half of the water is conveyed in the clockwise direction C by the water supply roller 24 as a water film 74*a*. The other one half is conveyed in the counterclockwise direction by the transfer roller 15 as the water film 74*b*. When the water film 74*a* reaches the contact point between the water supply roller 24 and the plate cylinder 12, it is combined with a water film 75 remaining on the plate cylinder 12. The combined water film is divided into two portions, one half 76*a* thereof being conveyed to the contact point between an inking roller 14 and the plate cylinder 12 to act as the wetting water, while the other half is returned back to the transfer roller 15 as a water film 76*b* to be combined with the water film 73. After passing through the nip between the water supply roller 24 and the transfer roller 15, the combined water film merges into the water film 74*b* which is returned to the nip between the transfer roller 15 and the adjusting roller 58 and most of the water is transferred onto the adjusting roller 58 to form a water film 77 which is combined with the water film 71. The combined water is recycled as above described or returned back to the container 54.

During the water feed operation described above, since the transfer roller 15 and the adjusting roller 58 rotate in the opposite directions at their contact point, most of the water supplied to this contact point, that is the water film 72*a* on the adjusting roller 58 with its speed adjusted, is transferred onto the transfer roller 15 which rotates at the same peripheral speed as that of the plate cylinder 12, whereas most of the water film 77 returned to the transfer roller 15 is transferred to the adjusting roller 58 and then returned back to the water container 54. As above described, since an adjusted quantity of water is supplied to the plate cylinder 12 it is possible to precisely adjust the quantity of the water supplied. Furthermore, as the surplus water is returned to the water container 54 through a path different from the normal feed path, the response speed of the adjustment is fast making the adjustment easy. Due to rapid recovery of the surplus water the balance of water and ink can be quickly recovered when the printing operation is restarted after an interruption.

Further, as the water supply apparatus is in direct contact with the plate cylinder at a point remote from the inking rollers and since the water returned back to the water supply roller 24 from the plate cylinder 12 is transferred to the transfer roller 15 without being supplied to the inking rollers, the surplus water is recovered at a high efficiency. Especially, when the water supply roller 24 engages a notch or groove (not shown) of the plate cylinder 12, the water supply is interrupted so that there is no fear of supplying surplus water to the inking rollers thus avoiding excessive emulsification of the ink due to admixture of the ink with an excessive quantity of water. In addition, as the thickness of the ink film on the water supply roller 24 is smaller than that of the ink film on the inking roller 14 no emulsification occurs on the water supply roller 24.

Figure 2:
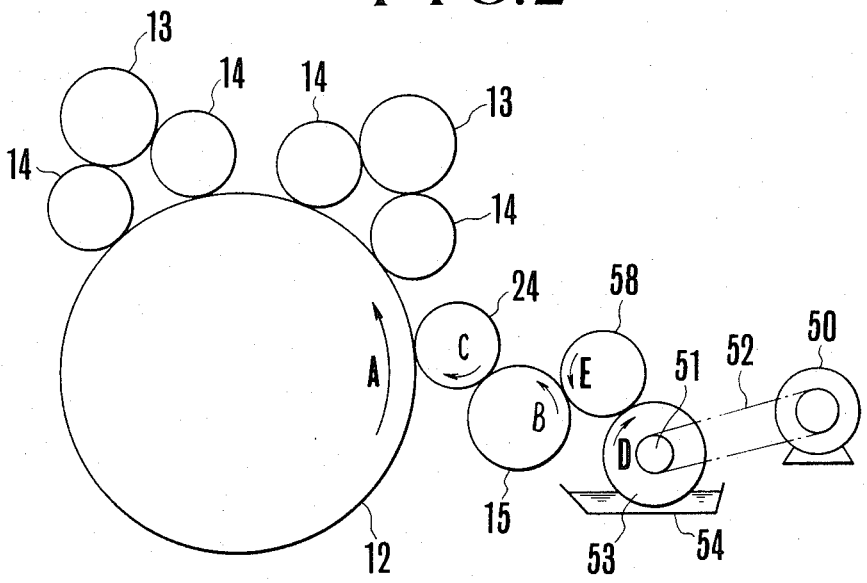
FIG. 2 is a diagrammatic side view showing the water supply apparatus embodying the invention and the inking devices.
Figure 6:
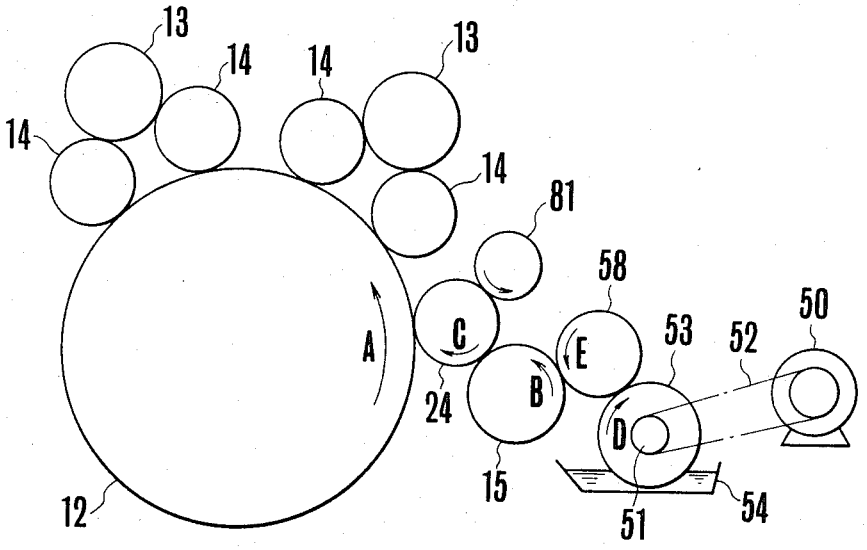
FIGS. 6 and 7 are side views similar to FIG. 2 showing other embodiments of this invention.

FIG. 6 shows a modified embodiment of this invention, in which elements corresponding to those shown in FIG. 2 are designated by the same reference characters. In this modification, a rider roller 81 is provided in contact with the periphery of the water supply roller 24. The rider roller 81 is provided with a hydrophilic surface and is constructed to be reciprocable in the axial direction. Then, the ink transferred from the plate cylinder 12 to the water supply roller 24 is uniformly distributed in the axial direction, thus making it possible to more uniformly distribute water on the water supply roller 24. It is advantageous to rotate the rider roller 81 at the same peripheral speed as that of the plate cylinder 12.

Figure 7:
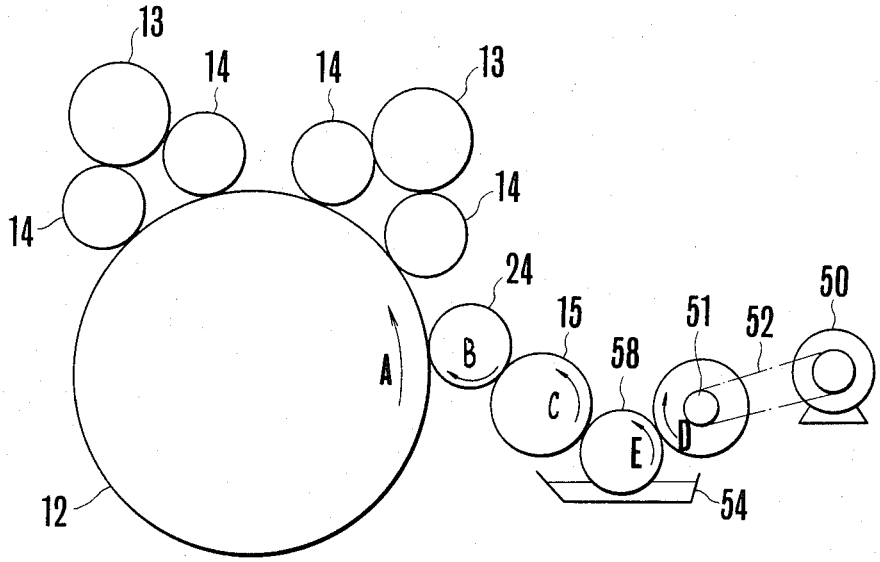

FIG. 7 shows still another embodiment of this invention in which water carrying rollers are arranged in the same manner as in FIG. 2. In this embodiment, instead of the water feed roller 53 shown in FIG. 2, the adjusting roller 58 is immersed in the water in the container 54. Then the water is sucked by the coarse resilient surface of the adjusting roller 58, thus facilitating picking up of the water with the result that the speed of rotation of the adjusting roller 58 can be reduced.

As above described, according to this invention a pair of rollers rotating in the opposite directions are included in a train of feed water carrying rollers, and the water supply roller is positioned apart from the inking rollers so as to supply to the plate cylinder a water film with controlled thickness and speed, thus supplying a minimum necessary quantity of wetting water and simplifying the adjustment of the quantity of water supplied. This also decreases the time required for adjustment which in turn decreases loss of paper. Furthermore, the quantity of water supplied to the inking rollers is decreased to insure proper balance between the quantities of water and ink thus preventing excessive emulsification of the ink. This improves the quality of the printed matter. In addition, it is not necessary to use alcohol to evaporate water, thus avoiding contamination of surrounding air.

Figure 8:
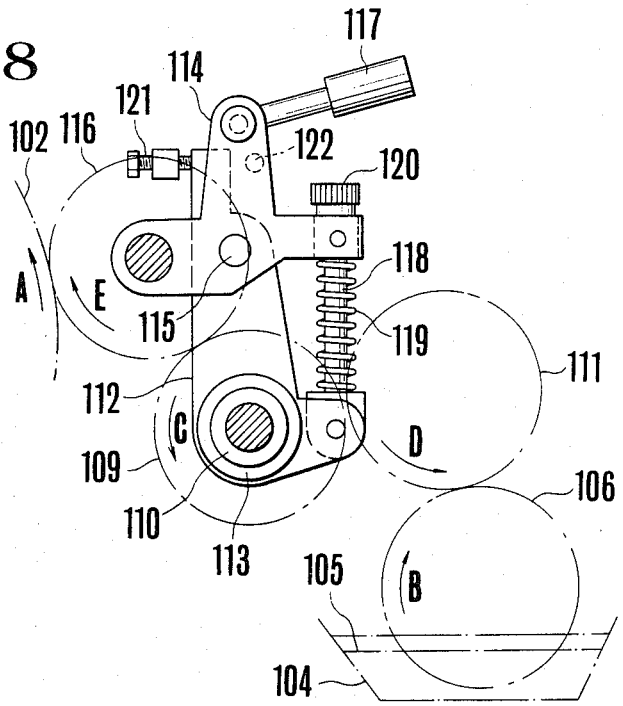
FIG. 8 is a side view of a modified water supply apparatus according to this invention.
Figure 9:
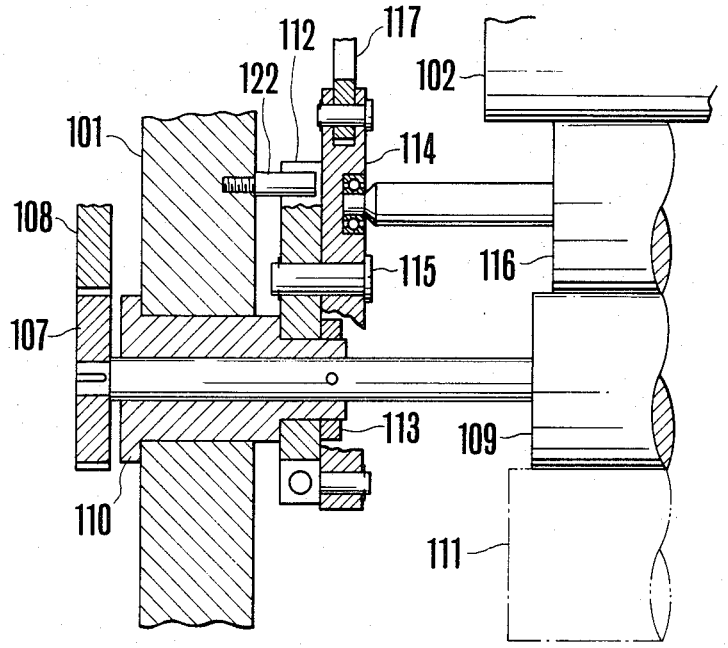
FIG. 9 is a partial vertical sectional view of the water supply apparatus shown in FIG. 8.

In a modification shown in FIGS. 8 and 9, a water feed roller 106 having a hydrophilic surface is immersed in a body of water 105 filled in a container 104. The opposite ends of the water feed roller 106 are supported by arms pivotally mounted on a machine frame 101. Between the water feed roller 106 and a plate cylinder 102 are provided a transfer roller 109 driven by gears 107 and 108 to rotate at the same peripheral speed as the plate cylinder 102 and supported by a bearing 110, and an adjusting roller 111 driven by the water feed roller 106 through gears, not shown, to rotate in a direction opposite to that of the transfer roller 109. The adjusting roller 111 has a resilient surface in contact with the water feed roller 106. The adjusting roller 111 is supported by an eccentric support and actuated by an air piston cylinder assembly, not shown, to engage and disengage the transfer roller 109 while its contact pressure to the water feed roller 106 is maintained at a constant value.

The bearings 110 supporting the opposite ends of the transfer roller 109 are provided with small diameter portions to which are rotatably mounted shift levers 112, the axial movement thereof being prevented by collars 113. An inverted T-shaped lever 114 is pivoted to the upper portions of each shift lever 112 through a pin 115. A water supply roller 116 having a resilient surface and rotated in the same direction at the same peripheral speed as the plate cylinder 102 is supported by the right hand arm of the lever 114 to contact against the plate cylinder 102. The upper end of the lever 114 is swung by a piston-cylinder assembly 117. A shaft 118 is provided between the left hand arm of the lever 114 and a horizontal projection of the shift lever 112 to support a compression spring 119 which urges the water supply roller 116 against the transfer roller 109. Both ends of the shaft 118 are pivotally connected to the levers 112 and 114, and its upper end is provided with a knob for adjusting the degree of compression of the compression spring 119 and hence the contact pressure between the water supply roller 116 and the transfer roller 109.

An adjusting screw 121, is threaded into the frame 101 to adjustably limit the rotation of the shift lever 112 so as to adjust the contact pressure between the water supply roller 116 and the plate cylinder 102. Furthermore, a stop pin 122 is secured to the frame 101 to limit the rotation of the shift lever 112 at a position at which the water supply roller 116 is slightly separated from the plate cylinder 102.

The modified embodiment shown in FIGS. 8 and 9 operates as follows.

After adjusting the contact pressures between respective rollers, the printing press is started. When the paper reaches a predetermined position, the piston-cylinder assembly 117 is operated to slightly rotate the lever 114 in the counterclockwise direction to occupy a position shown in FIG. 10. At this time, the shift lever 112 is prevented from rotating by the compression spring 119 with the upper end of the lever 112 engaged against the stop pin 122. As a consequence the water supply roller 116 is separated away from the plate cylinder 102 and brought into contact with the transfer roller 109. As the piston rod of the piston-cylinder assembly 117 is further extended to the position shown in FIG. 8, both levers 112 and 114 rotate in unison so as to urge the water supply roller 116 against the plate cylinder 102 because the water supply roller 116 is in contact with the transfer roller 109 so that the lever 114 can not rotate further. At the same time, the inking rollers 14 (see FIG. 2) are also urged against the plate cylinder 102. Thereafter the water 105 is fed to the plate cylinder 102 through the water feed roller 106, adjusting roller 111, transfer roller 109 and the water supply roller 116. Since these rollers rotate in the directions of arrows A through E, the water is fed in the same manner as in FIG. 5.

Figure 10:
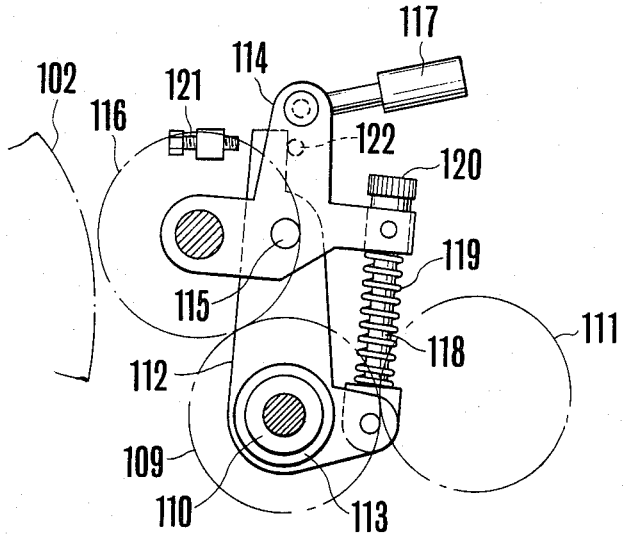

Concurrently with the stop of the rotation of the plate cylinder 102, the piston rod of the piston-cylinder assembly 117 is retracted from the position shown in FIG. 8 to the position shown in FIG. 10. Then both levers 114 and 112 rotate in unison in the counterclockwise direction to separate the water supply roller 116 away from the plate cylinder 102, and the upper end of the shift lever 112 engages against the stop pin 122. As the piston rod is further retracted, only the lever 114 rotates to compress the spring 119 to separate the water supply roller 116 away from the transfer roller 109 as shown in FIG. 11 because the shift lever 112 is prevented from rotating by the stop pin 122.

As above described, concurrently with the separation of the water supply roller 116 from the plate cylinder 102, the water supply roller 116 is also separated away from the transfer roller 109, so that the printing ink that has been transferred to the water supply roller 116 through the plate cylinder 102 would not be transferred to the transfer roller 109. Since the water supply roller 116 is instantly separated from the plate cylinder 102 and since the separation of the water supply roller 116 away from the plate cylinder 102 and the transfer roller 109 is performed by a single piston-cylinder assembly 117 or similar motive means it is possible to simplify the construction.

It will be appreciated that the drive for rotation of the levers 112 and 114 is not limited to the piston-cylinder assembly 117 but may be materialized by an oil-pressure cylinder, a cam mechanism or the like. While the foregoing embodiment has been described by way of example with reference to a four-roller reverse slip type water supply wherein two water carrying rollers are provided upstream of the transfer roller 109, and the adjusting roller 111 and the transfer roller 109 are rotated in the same direction, the number of water carrying rollers and their rotational directions may be selected optionally.

According to this embodiment it is possible to positively prevent transfer of the printing ink onto various water carrying rollers so that it is possible to form stable water films about these rollers thus improving the quality of the printed matter.

In the operation of the water supply apparatus of the type shown in FIGS. 2 and 6 it was found that stripes of ink are formed on the printed matter, and that this tendency becomes remarkable as the printing speed is increased. My research revealed such stripes are caused by air bubbles formed in the water container 54. More particularly, as the water feed roller 53 is rotated at a high speed in the container 54, the water therein is agitated to form many fine air bubbles which are entrapped in the water film formed about the water feed roller 53 and finally conveyed to the plate cylinder 12 to form the stripes. I have found that when the adjusting roller 58 in contact with the water feed roller 53 and the transfer rollers 15 is rotated at a peripheral speed of 1.5 times to twice of that of the water feed roller 53 such stripes can be eliminated. This speed relationship can be obtained by, for example, setting the gear ratio between the gear 56 for the water feed roller 53 and the gear for the adjusting roller 58 to be 1.5 to 2 so that the adjusting roller 58 can be rotated at the peripheral speed which is 1.5 to 2 times the peripheral speed of the water feed roller 53. This range of peripheral speed originates from experimental results. Thus, for peripheral speeds less than 1.5 times, insufficient elimination of air bubbles results whereas for peripheral speeds of more than twice, the rotation speed of the water feed roller 53 is lowered so great that efficiency of water feed is degraded, because the rollers following the adjusting roller 58 have an upper limit of rotation speed. Thus, when the adjusting roller 58 is rotated at a higher peripheral speed than the water feed roller 53, slip occurs at the contact surface therebetween thus eliminating the air bubbles contained in the water film. The tendency of forming air bubbles becomes remarkable when alcohol is incorporated into the wetting water 55 to enhance its evaporation.

When a swinging mechanism as shown in FIGS. 12 and 13 is provided for the transfer roller 15 to cause it to reciprocate in the axial direction, removal of the air bubbles can be made more effective. In addition to the removal of the air bubbles this axial reciprocating motion of the transfer roller 15 makes more uniform the thickness of the water film thereon. A grooved pulley 219 is secured to one end of the shaft of the transfer roller 15, and a crank lever 221 is pivotally mounted on one side of the frame 11 through an arm 220. A roller 222 secured to the lower end of one arm of the crank lever 221 is fitted into the groove of a pulley 219 so that a rod 223 connected to the other arm of the crank lever is reciprocated in the vertical direction, the transfer roller 15 is reciprocated in the axial direction as shown by solid lines and dot and dash lines in FIG. 12.

The peripheral speed ratio between the rollers 58 and 53 as set by the gear ratio between the drive gears for these rollers in the foregoing embodiment may otherwise be determined by the outer diameter ratio between these rollers or by the gear ratio and outer diameter ratio in combination. Further, the four-roller reverse slip type water supply exemplified in the foregoing embodiment by no means limit the number and rotational direction of the rollers employed in the present invention and these factors of the rollers are optional on condition that the peripheral speed ratio between the water feed roller and the adjusting roller making contact with the water feed roller for rotation is 1.5 to 2.

What is claimed is:

1. A water supply apparatus for a printing press comprising:

a water supply roller being rotatably in contact with a plate cylinder of said printing press and being positioned remote from an inking roller for said plate cylinder;

a transfer roller in contact with said water supply roller and rotatable at the same peripheral speed as said plate cylinder;

an adjusting roller rotatably in contact with said transfer roller, said adjusting and transfer rollers each having a periphery moving in opposite directions at said contact;

a water feed roller being rotatably in contact with said adjusting roller, said water feed roller being immersed in a body of water in a water container;

means for causing said water supply roller to move into and out of contact with both of said transfer roller and said plate cylinder; and means for adjusting contact pressure between said water supply roller and said transfer roller wherein said means for adjusting contact pressure comprises a shift lever rotatably mounted on a bearing supporting said transfer roller, an inverted T-shaped lever having a vertical leg and a horizontal leg pivotally connected to said shift lever, said water supply roller being supported by one end of said horizontal leg, compression spring means interposed between the other end of said horizontal leg and said shift lever, and motive means for swinging said inverted T-shaped lever.

2. The water supply apparatus of claim 1 wherein said adjusting roller has a resilient surface; and said transfer roller has a hydrophilic surface.

3. The water supply apparatus as claimed in claim 1 which further comprises a rider roller mounted on said water supply roller, said rider roller having a hydrophilic surface and being reciprocable in an axial direction thereof.

4. The water supply apparatus as claimed in claim 1 wherein said adjusting roller is rotated at a peripheral speed of one and one half times to twice of that of said water feed roller.

5. The water supply apparatus as claimed in claim 3 wherein said rider roller is reciprocated in an axial direction thereof.

6. A water supply apparatus as claimed in claim 1 which further comprises a swinging mechanism for reciprocating said transfer roller in an axial direction thereof.

7. A water supply apparatus for a printing press comprising:

a water supply roller adapted to be brought into rotatable contact with a plate cylinder of said printing press and being positioned remote from an inking roller for said plate cylinder;

a transfer roller having a hydrophilic surface and adapted to be brought into contact with said water supply roller and rotatable at the same peripheral speed as said plate cylinder;

an adjusting roller having a resilient surface and being rotatably in contact with said transfer roller, said adjusting and transfer rollers each having a periphery moving in opposite directions at said contact;

a water feed roller being rotatably in contact with said adjusting roller, said water feed roller being immersible in a body of water in a water container;

means for adjusting contact pressure between said adjusting roller and said transfer roller; and lever means coupling said water supply roller and said transfer roller, said lever means comprising a first lever pivotably mounted on said transfer roller, a second lever pivotably mounted on said water supply roller, and means for biasing said first and second levers about a pivotal interconnection, said lever means being selectively activated to engage said water supply roller with said plate cylinder, whereby said lever means is activated only after water is applied to said transfer roller.

8. The water supply apparatus as claimed in claim 7 and further comprising means for adjusting contact pressure between said water supply roller and said transfer roller.

9. The water supply apparatus as claimed in claim 7 wherein said adjusting roller is rotated at a peripheral speed one and one half times to twice of that of said water feed roller.

10. The water supply apparatus as claimed in claim 7 wherein said lever means cause said water supply roller to move into and out of contact with both of said transfer roller and said plate cylinder.

11. The water supply apparatus as claimed in claim 7 further comprising a swinging mechanism for reciprocating said transfer roller in an axial direction thereof.

12. A water supply apparatus for a printing press comprising a water supply roller being rotatably in contact with a plate cylinder of said printing press and being positioned remote from an inking roller for said plate cylinder;

a transfer roller in contact with said water supply roller and rotatable at the same peripheral speed as said plate cylinder;

an adjusting roller rotatably in contact with said transfer roller, said adjusting and transfer rollers each having a periphery moving in opposite directions at said contact;

a water feed roller being rotatably in contact with said adjusting roller, said water feed roller being immersible in a body of water in a water container; and means for adjusting contact pressure between said water supply roller and said transfer roller wherein said means for adjusting contact pressure comprises a shift lever rotatably mounted on a bearing supporting said transfer roller, an inverted T-shaped lever having a vertical leg and a horizontal leg pivotally connected to said shift lever, said water supply roller being supported by one end of said horizontal leg, compression spring means interposed between the other end of said horizontal leg and said shift lever, and motive means for swinging said inverted T-shaped lever.

13. The water supply apparatus as claimed in claim 12 and further comprising means for adjusting contact pressure between said water supply roller and said transfer roller.

14. The water supply apparatus as claimed in claim 12 wherein said adjusting roller is rotated at a peripheral speed one and one half times to twice of that of said water feed roller.

15. The water supply apparatus as claimed in claim 12 further comprising a swinging mechanism for reciprocating said transfer roller in an axial direction thereof.

16. A water supply apparatus for a printing press comprising:

a water supply roller being rotatably in contact with a plate cylinder of said printing press and being positioned remote from an inking roller for said plate cylinder;

a transfer roller in contact with said water supply roller and rotatable at the same peripheral speed as said plate cylinder;

an adjusting roller in contact with said transfer roller and rotatable in a direction opposite to the direction of rotation of said transfer roller;

a water feed roller being rotatably in contact with said adjusting roller, said water feed roller being immersible in a body of water in a water container;

motive means for causing said water supply roller to move into and out of contact with both of said plate cylinder and said transfer roller;

means for adjusting contact pressure between said water supply roller and said transfer roller wherein said means for adjusting contact pressure comprises:

a shift lever rotatably mounted on a bearing supporting said transfer roller;

an inverted T-shaped lever having a vertical leg and a horizontal leg pivotally connected to said shift lever;

said water supply roller being supported by one end of said horizontal leg;

compression spring means interposed between the other end of said horizontal leg and said shift lever; and said inverted T-shaped lever being coupled to said motive means.

17. The water supply apparatus as claimed in claim 16 which further comprises a rider roller being provided in contact with said water supply roller, said rider roller having a hydrophilic surface and being reciprocable in an axial direction thereof.

18. The water supply apparatus as claimed in claim 16 wherein said adjusting roller is rotated at a peripheral speed of one and one half times to twice of that of said water feed roller.

19. The water supply apparatus as claimed in claim 16 which further comprises a swinging mechanism for reciprocating said transfer roller in an axial direction thereof.

20. The water supply apparatus as claimed in claim 16 which further comprises another means for adjusting contact pressure between said water supply roller and said plate cylinder.

* * * * *

UNITED STATES PATENT AND TRADEMARK OFFICE

CERTIFICATE OF CORRECTION

PATENT NO. : 4,524,690

DATED : June 25, 1985

INVENTOR(S) : Tamotsu Omori

It is certified that error appears in the above-identified patent and that said Letters Patent is hereby corrected as shown below:

In The Abstract

Line 2, delete "platen roller" and insert ---- plate cylinder ----.

Line 5, delete "platen roller," and insert ---- plate cylinder, ----.

Line 7, delete "transfer" and insert ---- adjusting ----.

UNITED STATES PATENT AND TRADEMARK OFFICE

CERTIFICATE OF CORRECTION

PATENT NO. : 4,524,690

DATED : June 25, 1985

INVENTOR(S) : Tamotsu Omori

It is certified that error appears in the above-identified patent and that said Letters Patent is hereby corrected as shown below:

Column 1, line 56, after "applying" insert ---- roller ----.

Column 1, line 68, after "operation" insert a comma ---- , ----.

Column 2, line 22, delete "Accordngly" and insert ---- Accordingly ----.

Column 4, line 16, delete "rod", second occurrence.

Column 5, line 63, delete "cylinder" and insert ---- roller ----.

Column 9, line 66, delete "the" and insert ---- a ----.

In The Claims

Colunm 12, line 5, after "comprising" insert a colon ---- : ----.

Column 12, line 56, after "roller;" insert ---- and ----.

Signed and Sealed this

*Twentieth* Day of *May 1986*

[SEAL]

*Attest:*

DONALD J. QUIGG

*Attesting Officer*

*Commissioner of Patents and Trademarks*